US011219924B2

(12) United States Patent
Tetaz-Receveur et al.

(10) Patent No.: US 11,219,924 B2
(45) **Date of Patent: *Jan. 11, 2022**

(54) MAIL SORTING INSTALLATION WITH A TRAY CONVEYOR AND A TRAY-MANIPULATING SHUTTLE ROBOT

(71) Applicant: SOLYSTIC, Bagneux (FR)

(72) Inventors: Patrick Tetaz-Receveur, Saint Romans (FR); Laurent Pellegrin, Livron (FR)

(73) Assignee: SOLYSTIC, Bagneux (FR)

( * ) Notice: Subject to any disclaimer, the term of this patent is extended or adjusted under 35 U.S.C. 154(b) by 454 days.

This patent is subject to a terminal disclaimer.

(21) Appl. No.: 16/339,153

(22) PCT Filed: Dec. 12, 2018

(86) PCT No.: PCT/FR2018/053222
§ 371 (c)(1),
(2) Date: Apr. 3, 2019

(87) PCT Pub. No.: WO2019/158830
PCT Pub. Date: Aug. 22, 2019

(65) Prior Publication Data

US 2021/0331210 A1 Oct. 28, 2021

(30) Foreign Application Priority Data

Feb. 13, 2018 (FR) ..... 1851196

(51) Int. Cl.
*B07C 3/00* (2006.01)
*B07C 3/08* (2006.01)

(52) U.S. Cl.
CPC ..... *B07C 3/008* (2013.01); *B07C 3/08* (2013.01)

(58) Field of Classification Search
CPC ..... B07C 3/008; B07C 3/08; B65G 65/00; B65G 65/04
See application file for complete search history.

(56) References Cited

U.S. PATENT DOCUMENTS 5,435,690 A * 7/1995 Binning ..... B65G 57/112 414/791.6
2016/0167880 A1* 6/2016 Pankratov ..... B65G 1/1378 414/281

(Continued)

FOREIGN PATENT DOCUMENTS

| | | |
|---|---|---|
| DE | 199 01444 C1 | 2/2000 |
| FR | 3 040 900 A1 | 3/2017 |
| WO | 01/12348 A1 | 2/2001 |

*Primary Examiner* — Michael Mccullough
*Assistant Examiner* — Jessica L Burkman
(74) *Attorney, Agent, or Firm* — Ware, Fressola, Maguire & Barber LLP

(57) ABSTRACT

The sorting installation (1) of the invention includes sorting outlets (2) aligned along a sorting conveyor (3), each outlet having a recess (4) for receiving a tray (5) in which sorted mailpieces (6) are stored, and also a tray conveyor (8) that extends under the sorting outlets for moving full trays. The installation further includes a shuttle robot (9) provided with a chute (14) having a bottom end (14*a*) that is slidingly attached to a guide rail (10) extending along the tray conveyor, the shuttle robot being designed to extract a tray full of mail automatically from a recess in a sorting outlet and to drop it onto the top portion of the chute in such a manner that, on reaching the bottom of the chute, the tray is injected onto the tray conveyor under the effect of gravity.

7 Claims, 2 Drawing Sheets

(56) References Cited

U.S. PATENT DOCUMENTS

2017/0266697 A1* 9/2017 Chirol ..... B07C 3/008
2019/0009995 A1* 1/2019 Philipp ..... B65G 47/5109

* cited by examiner

MAIL SORTING INSTALLATION WITH A TRAY CONVEYOR AND A TRAY-MANIPULATING SHUTTLE ROBOT

CROSS REFERENCE TO RELATED APPLICATIONS

This application is the U.S. National Stage of International Application Number PCT/FR2018/053222 filed on Dec. 12, 2018, which application claims priority under 35 USC § 119 to French Patent Application No. 1851196 filed on Feb. 13, 2018.

Both applications are hereby incorporated by reference in their entirety.

TECHNICAL FIELD

The invention relates to the field of sorting mailpieces in trays in postal sorting centers.

More particularly, the invention relates to a sorting installation including sorting outlets aligned along a sorting conveyor, each outlet being provided with a recess for receiving a tray in which sorted mailpieces are stored, and also including a tray conveyor that extends under said sorting outlets for transporting trays full of sorted mailpieces from the sorting outlets to a feed inlet of the sorting conveyor.

PRIOR ART

A sorting installation of that type is described, for example, in Document WO-A-01/12348.

However, currently in postal sorting centers, trays filled with mailpieces from sorting outlets are moved to the tray conveyor manually by sorting operatives.

However, since the sorting outlets are arranged above the tray conveyor, operatives must extract the trays, which can weigh up to 25 kilograms (kg), at arm's length.

That handling of trays is therefore often the cause of muscle or joint problems for operatives.

SUMMARY OF THE INVENTION

An object of the invention is therefore to remedy the above-mentioned problems.

To this end, the invention provides a sorting installation including sorting outlets aligned along a sorting conveyor, each outlet being provided with a recess for receiving a tray in which sorted mailpieces are stored, and also including a tray conveyor that extends under said sorting outlets for transporting trays full of sorted mailpieces from the sorting outlets to a feed inlet of the sorting conveyor, the installation being characterized in that it further includes a shuttle robot suitable for traveling on the floor in autonomous manner along the sorting outlets, which robot is provided with handling means suitable for extracting a tray from a recess of a sorting outlet and for placing it on the tray conveyor, said handling means including a chute having a bottom end that is slidingly attached to a guide rail extending along said tray conveyor, the handling means being arranged so as to place the tray extracted from the sorting outlet onto the top portion of the chute in such a manner that, on reaching the bottom of the chute, the tray is injected onto the tray conveyor under the effect of gravity.

The idea forming the basis of the invention consists in eliminating operative handling of the trays from the sorting outlets to the conveyor and using a simple and non motor-driven system to inject the tray onto the conveyor.

The sorting equipment of the invention may also have the following features:

- the shuttle robot includes a structure carrying a vertical guide rail in which the top end of said chute is slidably mounted and in that the bottom end of the chute is connected mechanically to the structure by a set of rods forming a parallelogram suitable for deforming in order to compensate for a variation in height between the floor on which the shuttle robot travels and said guide rail;
- the shuttle robot includes a return spring that tends to pull upwards the top end of the chute sliding in said guide rail;
- the shuttle robot includes a return spring that tends to pull downwards the bottom end of the chute; and
- the chute has a slide surface constituted by rollers.

In this embodiment, the idea consists in preventing the shuttle robot uncoupling from the rail when the height between the floor and the shuttle robot is not the same as the height between the floor and the tray conveyor.

Thus, the use of two rods in a deformable parallelogram makes it possible to accommodate this variation in height and in particular the forward tipping movements of the chute.

In advantageous manner, in this embodiment the chute maintains a constant slope during movement of the shuttle robot so as to enable a tray to slide to the conveyor below each sorting outlet.

BRIEF DESCRIPTION OF THE DRAWINGS

The present invention can be better understood and other advantages appear on reading the following detailed description of the embodiment given by way of non-limiting example and with reference to the accompanying drawings, in which.

DESCRIPTION OF THE EMBODIMENT

Figure 1:
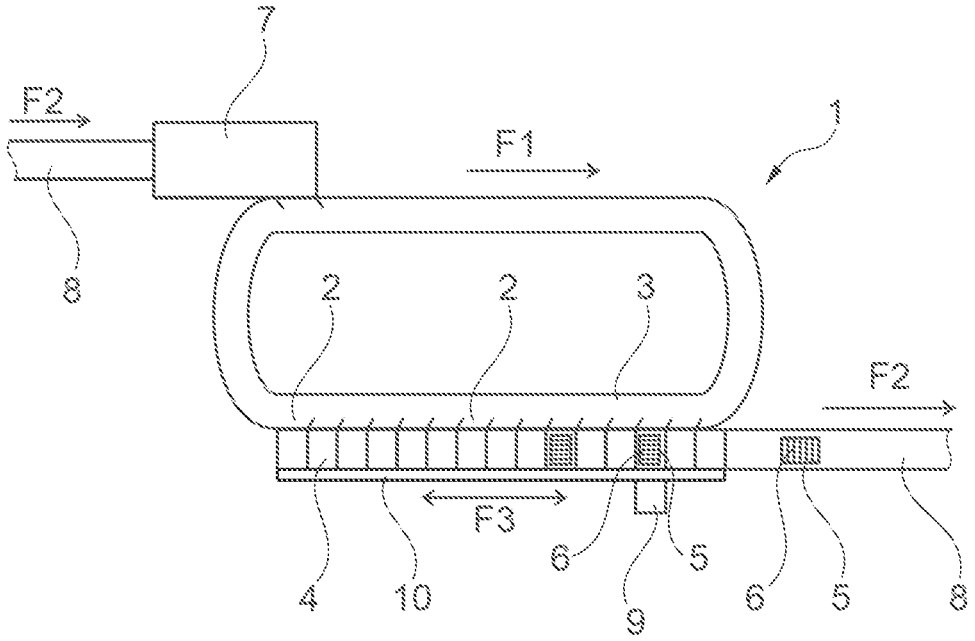
FIG. 1 is a diagrammatic view from above of a sorting installation of the invention.

FIGS. 1, 2*a*, 2*b* and 2*c*, show a sorting installation 1 of the invention that includes sorting outlets 2 aligned along a sorting conveyor 3, each outlet being provided with a recess 4 for receiving a tray 5 in which sorted mailpieces 6 are stored.

FIG. 1 also shows a feed inlet 7 designed for putting mailpieces 6 in series on the sorting conveyor 3 in the conveying direction F1 for subsequent sorting into the corresponding sorting outlets 2.

A tray conveyor 8 is also provided under the sorting outlets 2 in order to convey the trays 5 filled with mailpieces 6 from the sorting outlets 2 to the feed inlet 7 in a conveying direction F2.

In this example, a tray 5 is extracted from a recess 4 of a sorting outlet 2 and is injected onto the tray conveyor 8 under said sorting outlet 2 by means of a shuttle robot 9 suitable for traveling on the floor S1 in autonomous manner along the sorting outlets 2 in the travel direction F3.

The shuttle robot 9 couples to a guide rail 10 that extends in front of the tray conveyor 8 over its entire length, as can be seen in FIGS. 1 and 2*a* to 2*c*.

Figure 2A:
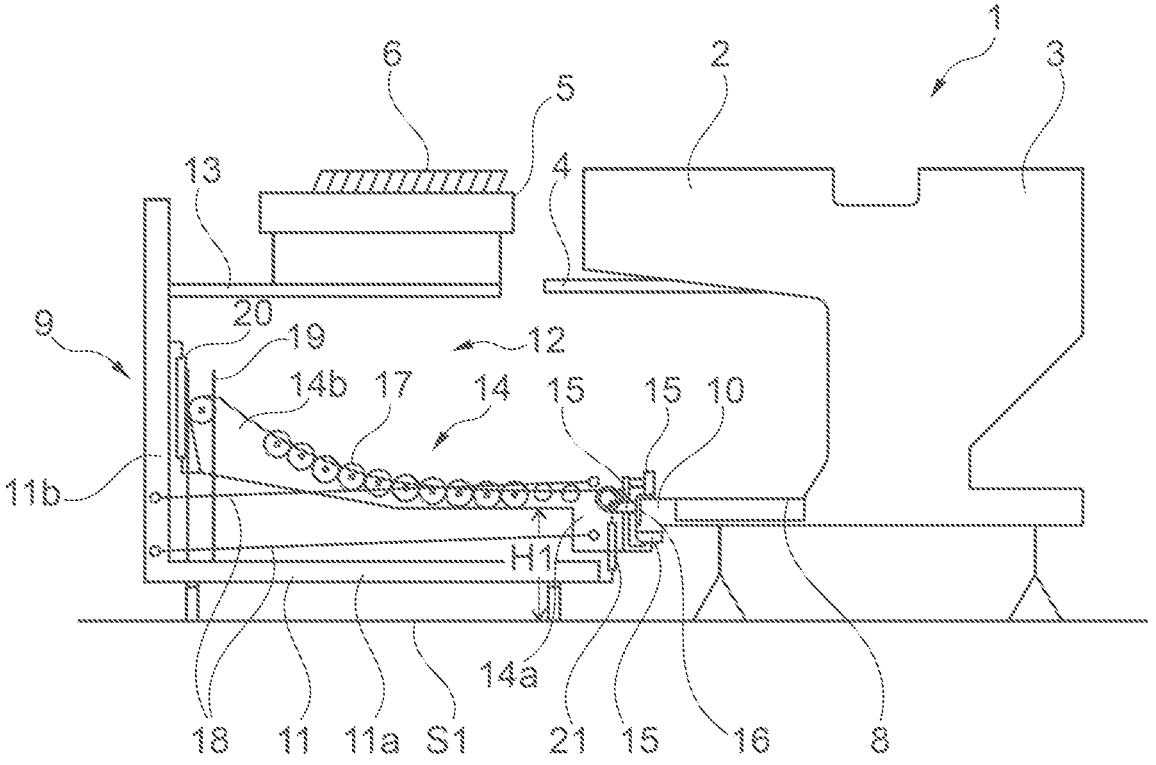
FIGS. 2*a* to 2*c* are diagrams showing the shuttle robot in front of various sorting outlets of the sorting installation of the invention.

As shown in FIG. 2*a*, the shuttle robot 9 comprises a structure 11, in this embodiment an L-shaped structure with a wheeled platform 11*a* and a back plate lib, on which there are mounted handling means 12 suitable for extracting a tray from a recess of a sorting outlet and for placing it on the tray conveyor.

The handling means 12 include a motor-driven pickup head 13 comprising two horizontal parallel bars that are telescopic and movable vertically in order to extract a tray 5 from the recess 4 of a sorting outlet 2.

The handling means also include a tray chute 14 that extends under the telescopic head 13 from a top end 14*b* towards a bottom end 14*a* that is used to provide sliding coupling with the guide rail 10.

The bottom end 14*a* of the chute is coupled to the guide rail 9 by means of three guide wheels 15 that come to bear against an abutment 16 of the guide rail 9.

Figure 2B:
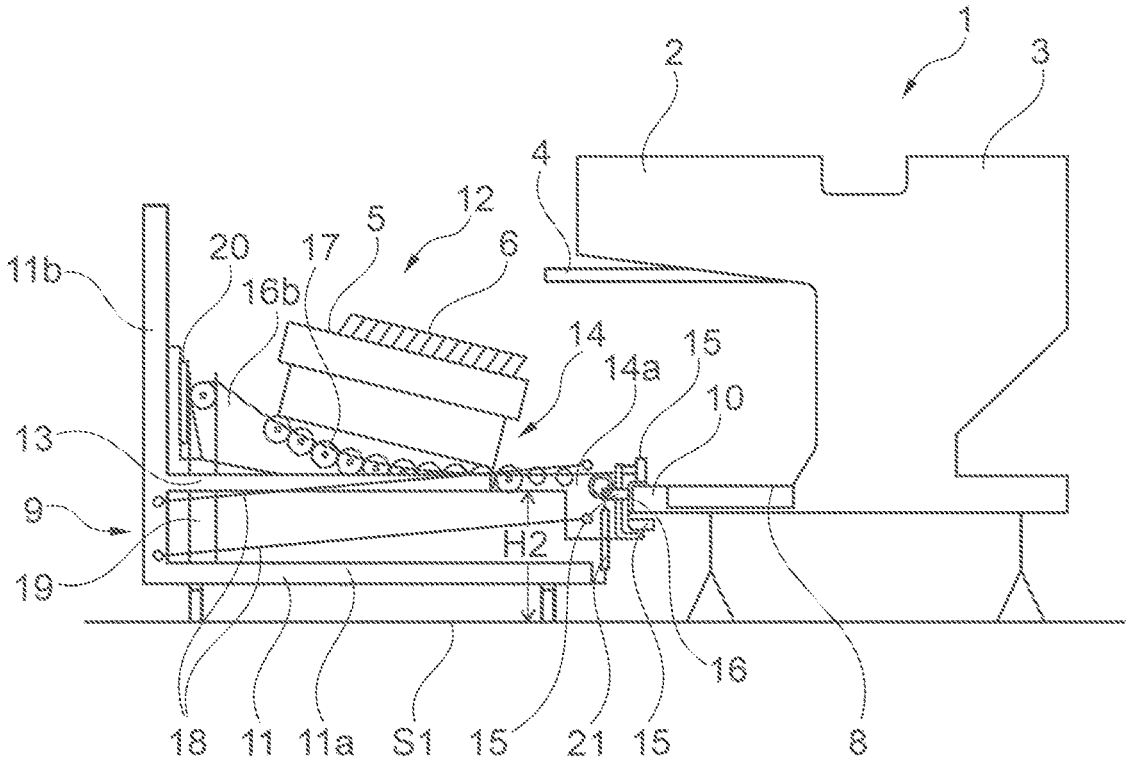

As can be seen in FIG. 2*b*, the bottom end 14*a* of the chute comes flush with the tray conveyor 8 so that each tray 5 can slide directly from the chute onto the conveyor without manual intervention or motor-driven means.

The slope of the chute 14 is therefore selected so that the trays 5 slide by gravity onto the tray conveyor 8.

The chute 14 could also comprise rollers 17 mounted to be free to turn so as to facilitate sliding of the trays 5 and accept smaller gradients for the slope of the chute.

The telescopic pickup head 13 moves down and unloads the tray 5 extracted from the recess 4 of the sorting outlet 2 onto the top portion of the chute 14 so that it can be injected onto the tray conveyor 8.

The shuttle robot 9 also comprises two connecting rods 18 that are parallel one above the other and that connect the bottom end 14*a* of the chute mechanically to the structure 12 of the shuttle robot 9 so as to form a parallelogram suitable for being deformed when there is a variation in height between the floor S1 and the guide rail 10 and/or the bottom end 14*a* of the chute.

The rods 18 preferably have ties of identical length so that the distance between the structure 12 and the bottom end 14*a* of the chute is always the same.

In non-restrictive manner, two sets of rods 18 could be used and placed on either side of the structure 12 in the manner of two vertical side walls.

In this embodiment, the rods 18 perform multiple functions consisting in holding the chute 14 parallel with the structure 12 relative to the guide rail 10, in holding the chute 14 tensioned on the structure 9, and in avoiding tipping of the chute 14 at its bottom end 14*a*.

Figure 2C:
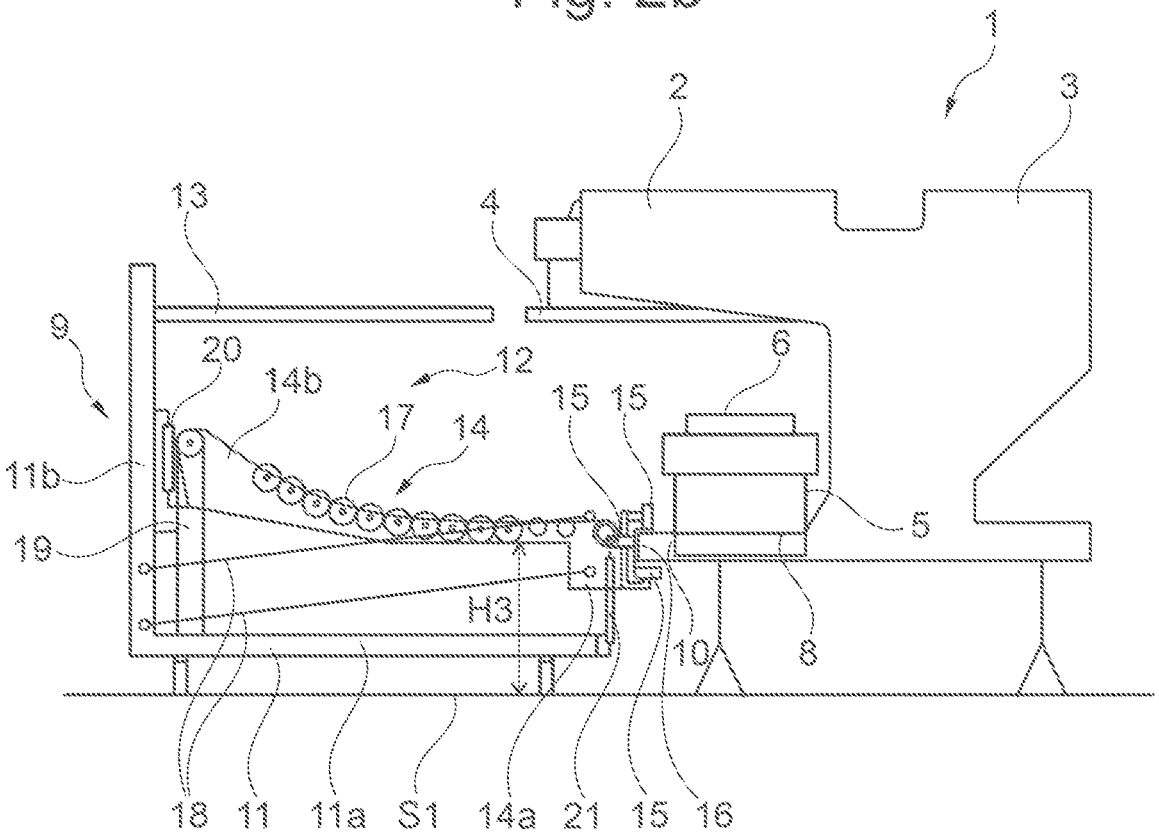

In this embodiment, the shuttle robot 9 shown in FIGS. 2*a* to 2*c* is attached to the tray conveyor 8 in front of various sorting outlets 2.

In FIG. 2*a*, the height H1 between the floor S1 and the bottom end 14*a* of the chute is less than the height H2 of FIG. 2*b*, which is itself less than the height H3 shown in FIG. 2*c*.

Thus, the greater the height between the floor S1 and the bottom end 14*a* of the chute, the more the parallelogram formed by the rods 18 is deformed.

The slope of the chute is thus constant and uncoupling of the shuttle robot 9 at the three guide wheels 15 with the tray conveyor 8 is avoided, in particular uncoupling of the guide wheel 15 that is situated under the tray conveyor 8, which prevents uncoupling of the shuttle robot 9 by frontal traction relative to the tray conveyor 8, which generally becomes uncoupled when the chute 14 tips forwards.

In addition, in order to accommodate the variation in height between the bottom end 14*a* of the chute and the floor S1, the shuttle robot 9 includes a guide rail 19 that extends vertically from the base of the structure 12 and in which the top end 14*b* of the chute 14 is slidably mounted.

Sliding of the top end 14*b* of the chute in the guide rail 19 could also be damped by means of a return spring 20, or of an elastic, that tends to pull upwards the top end 14*b* of the chute sliding in said guide rail 19.

Finally, with the aim of holding the bottom portion 14*a* of the chute pressed against the guide rail 10 of the tray conveyor 8, a return spring 21 is arranged between the bottom end 14*a* of the chute and the structure, that tends to pull the bottom end 14*a* of the chute down towards the floor S1.

Without restricting the ambit of the invention, a plurality of shuttle robots 9 could be used on the same guide rail 10 so as to accelerate the rate at which trays 5 are extracted from and injected onto the tray conveyor 8.

The invention claimed is:

1. A sorting installation comprising:

sorting outlets aligned along a sorting conveyor, each outlet being provided with a recess for receiving a tray in which sorted mailpieces are stored, a tray conveyor that extends under said sorting outlets for transporting trays full of sorted mailpieces from the sorting outlets to a feed inlet of the sorting conveyor, and a shuttle robot suitable for traveling on the floor in autonomous manner along the sorting outlets, wherein the robot is provided with handling means comprising motor driven pickup head comprising two horizontal parallel bars that are telescopic and movable vertically, said handing means being suitable for extracting a tray from a recess of a sorting outlet and for placing it on the tray conveyor, said robot including a chute having a bottom end that is slidingly attached to a guide rail extending along said tray conveyor, the handling means being arranged so as to place the tray extracted from the sorting outlet onto the top portion of the chute in such a manner that, on reaching the bottom of the chute, the tray is injected onto the tray conveyor under the effect of gravity.

2. The sorting installation according to claim 1, wherein said shuttle robot includes a structure carrying a vertical guide rail in which the top end of said chute is slidably mounted and in that the bottom end of the chute is connected mechanically to the structure by a set of rods forming a parallelogram suitable for deforming in order to compensate for a variation in height between the floor on which the shuttle robot travels and said guide rail.

3. The sorting installation according to claim 2, wherein said shuttle robot includes a return spring that pulls the top end of the chute sliding in said guide rail upwards.

4. The sorting installation according to claim 3, wherein said shuttle robot includes a return spring that pulls the bottom end of the chute downwards.

5. The sorting installation according to claim 4, wherein said chute has a slide surface made by rollers.

6. The sorting installation according to claim 1, wherein said shuttle robot includes a return spring that pulls the bottom end of the chute downwards.

7. The sorting installation according to claim 1, wherein said chute has a slide surface made by rollers.

* * * * *